US006439847B2

(12) United States Patent
Taeck

(10) Patent No.: US 6,439,847 B2
(45) Date of Patent: Aug. 27, 2002

(54) AIR-COOLED TURBINE BLADE

(75) Inventor: Ulrike Taeck, Baden (CH)

(73) Assignee: ALSTOM (Switzerland) Ltd., Baden (CH)

( * ) Notice: Subject to any disclaimer, the term of this patent is extended or adjusted under 35 U.S.C. 154(b) by 0 days.

(21) Appl. No.: 09/774,082

(22) Filed: Jan. 31, 2001

(30) Foreign Application Priority Data

Jan. 31, 2000 (DE) ..... 100 04 128

(51) Int. Cl.[7] ..... F01D 5/08
(52) U.S. Cl. ..... 416/96 A; 416/97 R; 415/12
(58) Field of Search ..... 415/12, 115; 416/96 A, 416/97 R

(56) References Cited

U.S. PATENT DOCUMENTS

| | | | |
|---|---|---|---|
| 3,806,275 A | * | 4/1974 | Aspinwall |
| 4,153,386 A | * | 5/1979 | Leogrande et al. |
| 4,859,141 A | | 8/1989 | Maisch et al. |

FOREIGN PATENT DOCUMENTS

| | | |
|---|---|---|
| DE | 1476790 | 3/1970 |
| DE | 2320581 | 5/1975 |
| DE | 3629910 A1 | 3/1988 |
| EP | 0182588 | 5/1986 |
| EP | 0258754 | 3/1988 |
| EP | 0534207 A1 | 3/1993 |

OTHER PUBLICATIONS

"Shape Memory Alloys", Metals Handbook Desk Edition, p. 668–669.

* cited by examiner

*Primary Examiner*—F. Daniel Lopez
*Assistant Examiner*—James M McAleenan
(74) *Attorney, Agent, or Firm*—Burns, Doane, Swecker & Mathis, L.L.P.

(57) ABSTRACT

An air-cooled turbine blade (1) is provided in the cavity (5) of the blade body (3) with an insert (6) made of a shape memory alloy. Due to the contraction of the insert (6) after a certain temperature threshold value is exceeded, the cooling system (12) of the turbine blade (1) is enlarged in the interior. The size of the cooling system (12) (effectiveness of the cooling, cooling-air quantity, size of cooling passages) is therefore advantageously dependent upon the ambient temperature.

11 Claims, 4 Drawing Sheets

AIR-COOLED TURBINE BLADE

An air-cooled turbine blade according to the invention includes a cavity within which an insert of variable size is provided. As the insert varies in size, the size of a cooling passage at least partially defined by the insert is also changed. Such turbine blades are used as guide or moving blades, for example, in gas turbines.

BACKGROUND OF INVENTION

It has been known to cool the parts of thermal turbomachines subjected to hot gas, such as, for example, turbine blades of gas turbines, by means of a cooling medium in order to be able to increase the temperature of the hot gas, and to prolong the service life of the parts concerned by reducing thermal loading. For this purpose, cooling holes are provided in the wall of the turbine blade and other cooling systems are provided in the interior of the turbine blade. The inside of the turbine blade is cooled as the cooling air dissipates the heat to the outside. The outside of the blade is cooled by a film which forms on the surface of the turbine blade.

In the case of conventional turbine blades, the cavity may be provided with one or more inserts in order to obtain a certain cooling structure. Such inserts are described, for example, in publications DE-A-23 20 581, EP 0 534 207, EP 0 182 588 or also in DE-A1476 790. In these disclosures, there are in some cases, in addition to the insert, further built-in components in the interior in order to cool certain parts of the turbine blade in an improved manner relative to other parts or to utilize the cooling air more effectively. Thus there are ribs on the wall of the cavity, which together with the insert form clearly defined cooling passages, constrictions for improved cooling, for example of the pressure side of the blade, or cooling holes in the insert for the (impingement) cooling of the leading edge or of one of the two sides.

A turbine blade has also been disclosed by U.S. Pat. No. 4,859,141, which provides an insert which is made of a shape memory alloy. When a certain temperature threshold value is exceeded, the insert expands and in this way bears free of play against the internal geometry.

For the development of turbine blades, which must meet the continuously increasing temperatures of gas turbines, it is essential to provide improved cooling systems. Conventional inserts, however, do not allow for variances in the size of the cooling system, and in particular the size of the cooling passages, as a function of the temperature of the hot gases. This is because conventional inserts are rigid and the size of the cooling system/cooling passages does not change as a function of the temperature during the operation of the gas turbine. This has an adverse effect, since it is desirable to cool certain regions of the turbine blade more intensively relative to other regions of the turbine blade as a function of the temperature acting from outside.

SUMMARY OF THE INVENTION

The invention avoids the above mentioned disadvantages. An air-cooled turbine blade includes an insert which regulates the cooling (effectiveness of the cooling, cooling air quantity, size of cooling passages) in the interior of the cavity as a function of the temperature of the hot gas during operation of the gas turbine.

A turbine blade includes an insert, wherein the size of the insert, after a temperature predetermined by the composition of the shape memory alloy is exceeded, is changed in such a way that the cooling system is changed, i.e. enlarged or reduced in size, as a result.

In order to reduce the overall size of the insert, it is especially advantageous if the insert includes a strap with two overlapping ends. In a thermally activated state, the insert can be reduced in size overall by the two ends being pushed one over the other.

The insert can also be formed with only individual portions of the insert being provided with a shape memory alloy. This allows the insert to be used to specifically cool certain parts of the turbine blade in an intensified manner. One or more articulations in the form of bends or curves in the shape memory alloy can be provided to permit local changes in the size of the insert. This may be effected, for example, in the vicinity of the leading edge of the turbine blade, on the pressure or suction side, or over the height of the blade body.

The insert can also be used in connection with ribs arranged radially or axially on the inner wall of the cavity. In this case, the insert can be shaped to cover the ribs and reduce the size of the cooling passages defined between the ribs by portions that project into the intermediate spaces between the ribs. When the insert contracts as a result of a change in temperature, the ribs are covered in a flush manner and the cooling passages are enlarged as the portions withdraw from between the ribs.

In order to utilize the effect of the contraction of the insert in the thermally activated state, and also to ensure retention of the insert on the blade body of the turbine blade, it is necessary to mechanically fasten the insert by brazing or welding to one or more points on the wall of the blade body, to the ribs, to the tip, or to the platform of the turbine blade.

Cooling holes may also be advantageously provided in the insert in order to intensify the effect of the cooling.

Shape memory alloys used for the insert can include, for example, NiTi, Cu—Zn—Al or Cu—Al—Ni.

DESCRIPTION OF THE PREFERRED EMBODIMENTS

Figure 1:
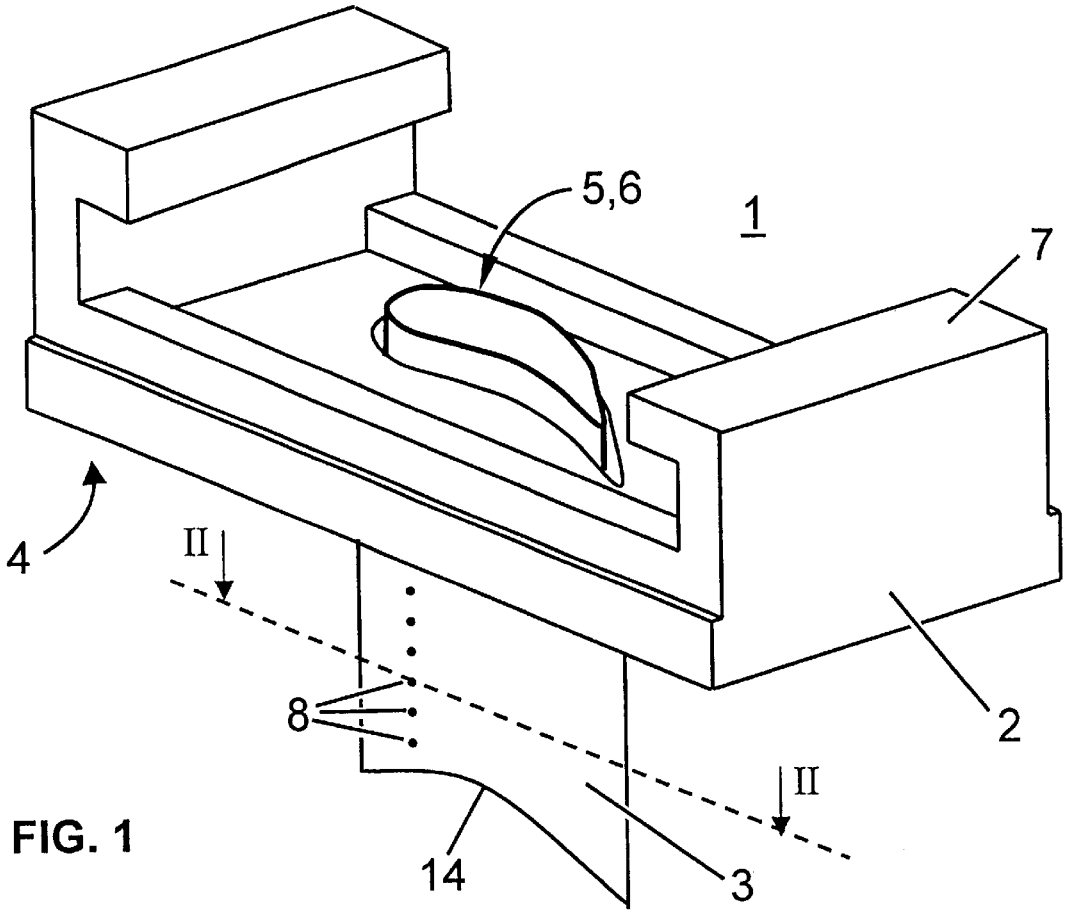
FIG. 1 shows a turbine blade (guide or moving blade) of a gas turbine with an insert according to the invention.

FIG. 1 shows a turbine blade 1 of a gas turbine. This turbine blade is normally a guide or moving blade which is fastened to the rotor or the stator of the gas turbine. For the purpose of fastening the turbine blade 1, a fastening means 7 on a platform 2 is provided in the top region of the turbine blade 1. A blade body 3 is fastened to the platform 2. The platform 2 has a surface 4 exposed to the hot gases of the gas turbine. The blade body 3 is provided with a cavity 5, in which an insert 6 is located. For the purpose of cooling, the cavity 5 is provided with a cooling system 12 (not shown in any more detail in FIG. 1). The cooling system 12 enables the walls of the blade body 3 to be cooled by cooling air which has been introduced into the cavity 5. Cooling holes 8 are provided on the surface of the blade body 3 for the cooling air to leave the blade body 3. The number of cooling holes shown in FIG. 1 and their arrangement on the surface are merely exemplary and depend on the type of insert of the turbine blade 1. Numerous cooling systems have been disclosed by the prior art and are therefore not explained in any more detail here.

Figure 2A:
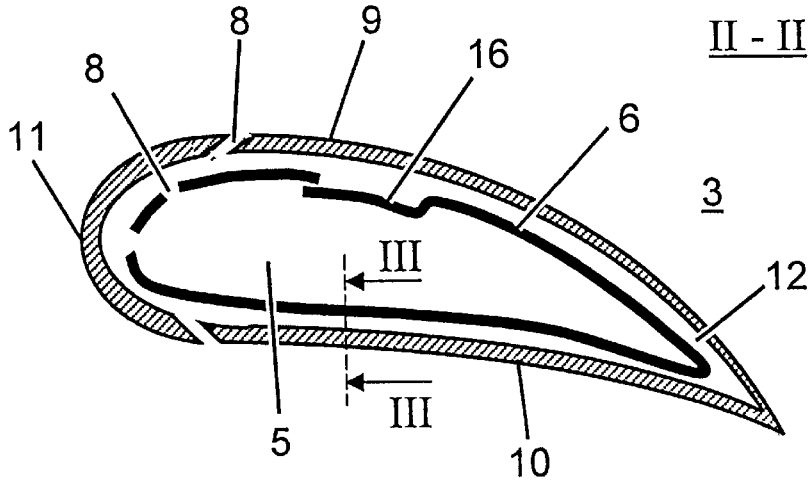
FIG. 2*a* shows a section through the turbine blade along line II—II in FIG. 1 with a first embodiment of an insert according to the invention, which is not activated thermally.

FIG. 2*a* shows a section through the blade body 3 along line II—II in FIG. 1. The blade body 3 has a suction side 9, a pressure side 10 and a leading edge 11. The insert 6 is located in the cavity 5. The cooling system 12 introduces cooling air in a specific manner between the insert 6 and the cavity 5. For example, the cooling air can be introduced in the center of the insert 6 and can penetrate between the insert 6 and the wall of the blade body 3 through cooling holes 8 which in FIG. 1 are present in an exemplary manner in the front part of the insert 6. The cooling air can leave the turbine blade 1 again through the cooling holes 8 which are present in the wall of the blade body 3.

The insert 6 is made of a shape memory alloy, SMA. The properties of shape memory alloys are summarized, for example, in *The Metals Handbook, Desk Edition, Second Edition, Ed. by J. R. Davis, ASM International, pages* 668/669. Shape memory alloys, which consist of nickel and titanium with a proportion (% by weight) of 49–51% Ni and 51–49% Ti, are known in principle. Such an alloy is available on the market, for example under the name Nitinol. In addition, there are further shape memory alloys in the tertiary system Cu—Zn—Al or Cu—Al—Ni. These types of shape memory alloys are suitable in principle for the insert 6 in the present patent application.

Figure 2B:
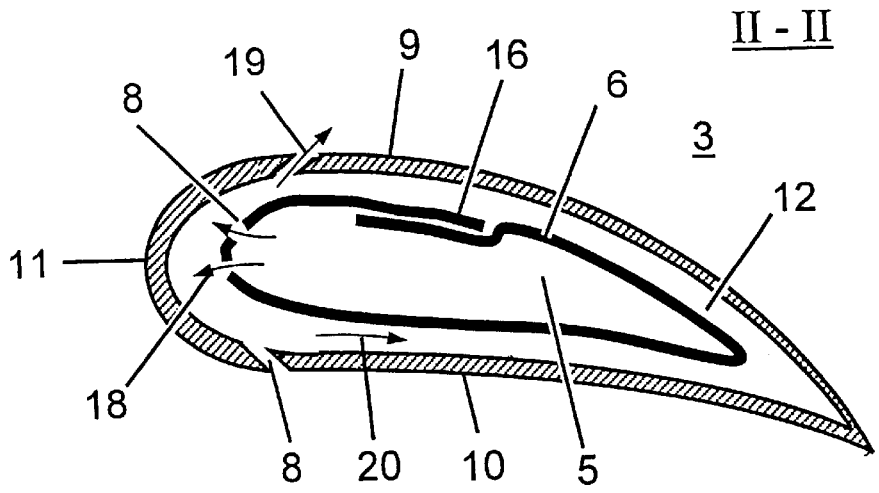
FIG. 2*b* shows a section through the turbine blade along line II—II in FIG. 1 with the first embodiment of an insert according to the invention, which is activated thermally.

Shape memory alloys have the property of returning to their original shape (memory effect) if a temperature established by the material is exceeded. This memory effect is utilized in the subject matter of the present application. FIG. 2*a* shows the insert 6 in expanded form, at a temperature below the temperature threshold value of the shape memory alloy. The insert 6 includes a strap 16 having two overlapping ends. During operation of the gas turbine, the predetermined temperature is exceeded by admission of the hot gases to the turbine blade 1 and the insert 6 contracts with the two ends being pushed one over the other. As a result, the insert 6 is reduced in size overall. This state is shown in FIG. 2*b*. The cooling system 12 is advantageously enlarged due to the reduction in size of the insert 6. The quantity of the cooling air and the size of the cooling system 12 increase and thus serve to cool the walls of the blade body 3 in an intensified manner. The size of the cooling system can also be increased at other locations in order to improve the cooling of parts of the turbine blade 1 which are subjected to greater thermal loading relative to the parts which are subjected to less thermal loading.

FIG. 2*b* schematically shows with the aid of arrows the possible cooling mechanisms of a turbine blade 1 inside the cooling system 12. Impingement cooling 18 is obtained in the vicinity of the leading edge 11 by impingement of cooling air on the leading wall. The cooling air sweeping along the walls provides for convection cooling 20. In addition, by discharge from the cooling holes 8 located in the wall of the turbine blade 1, further film cooling 19 occurs at the outer surface of the blade body.

Figure 2C:
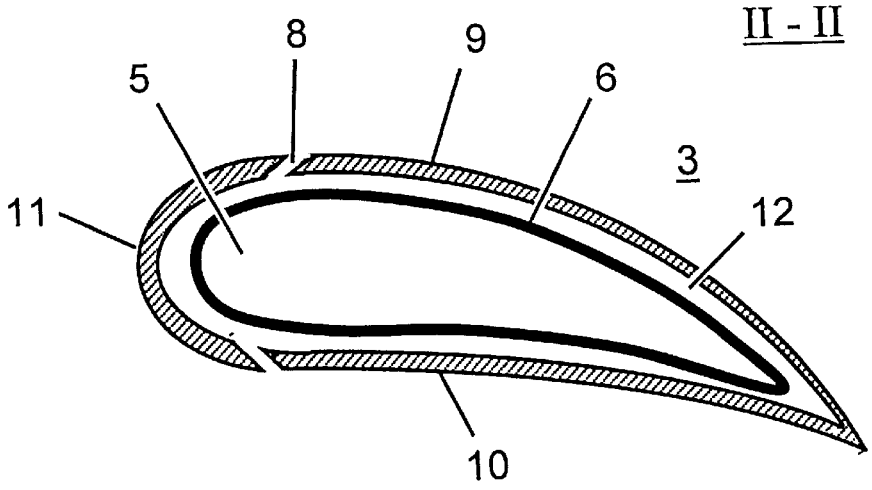
FIG. 2*c* shows a section through the turbine blade along line II—II in FIG. 1, with a second embodiment of an insert according to the invention, which is not activated thermally.
Figure 2D:
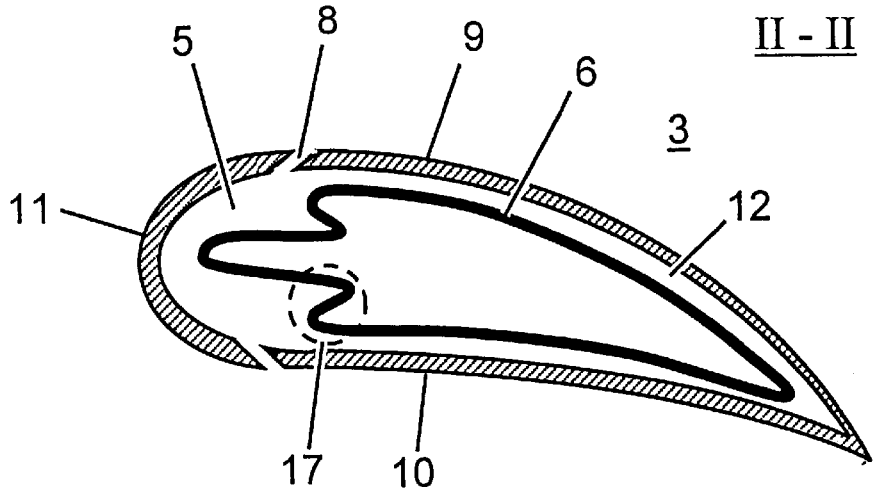
FIG. 2*d* shows a section through the turbine blade along line II—II in FIG. 1, with the second embodiment of an insert according to the invention, which is activated thermally.

FIGS. 2*c* and 2*d* show a second embodiment of an insert 6 according to the invention. FIG. 2*c* shows the insert, which is not activated thermally, below the predetermined temperature of the shape memory alloy, and FIG. 2*d* represents the insert 6 in the thermally activated state due to a temperature increase. The special feature of this embodiment is that the properties of the shape memory alloy specifically act only on the tip of the insert 6. This means that only the tip, which is located in the front region in the vicinity of the leading edge 11 of the turbine blade 1, is made of the shape memory alloy, and a type of articulation 17 is located between this tip and the rear part. This articulation 17 provides for the "bending-in" of the insert at a predetermined location. It may be present in the form of bends, preliminary folds or curves in the shape memory alloy. By means of this embodiment, the leading edge 11, which is especially stressed, is supplied with an increased amount of cooling air and is therefore cooled to a greater extent than other portions of the blade.

Figure 2E:
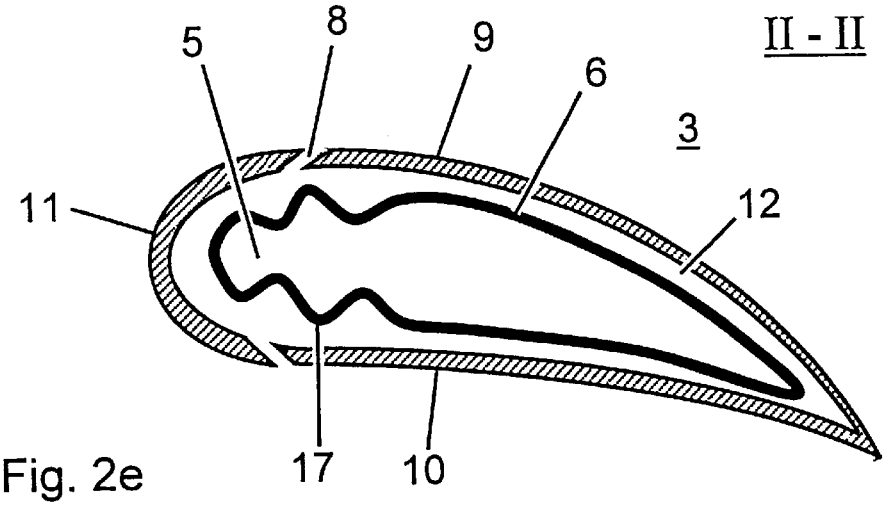
FIG. 2*e* shows a section through the turbine blade along line II—II in FIG. 1, with a second embodiment of an insert according to the invention, which is not activated thermally.
Figure 2F:
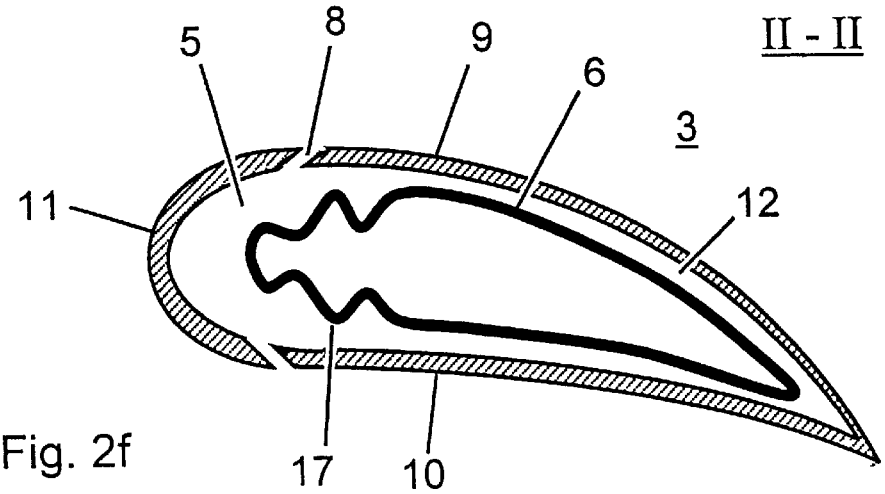
FIG. 2*f* shows a section through the turbine blade along line II—II in FIG. 1, with the second embodiment of an insert according to the invention, which is activated thermally.

FIGS. 2*e* and 2*f* are analogous to FIGS. 2*c* and 2*d*. They show the shape memory alloy in a thermally activated/thermally inactivated embodiment. Unlike FIGS. 2*c* and 2*d*, the tip of the shape memory alloy is provided with a plurality of "articulations" 17, so that thermal activation leads to folding of the tip.

Figure 3A:
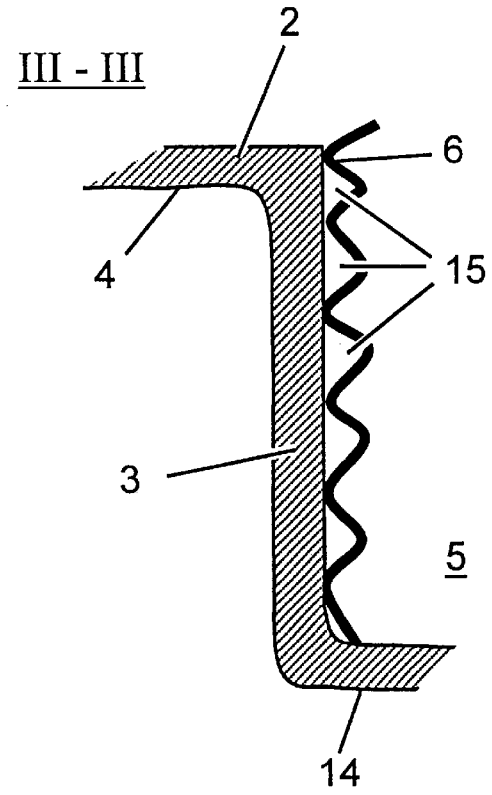
FIG. 3*a* shows a section through the turbine blade along line III—III in FIG. 2*a*, with a further embodiment of an insert according to the invention, which is not activated thermally.
Figure 3B:
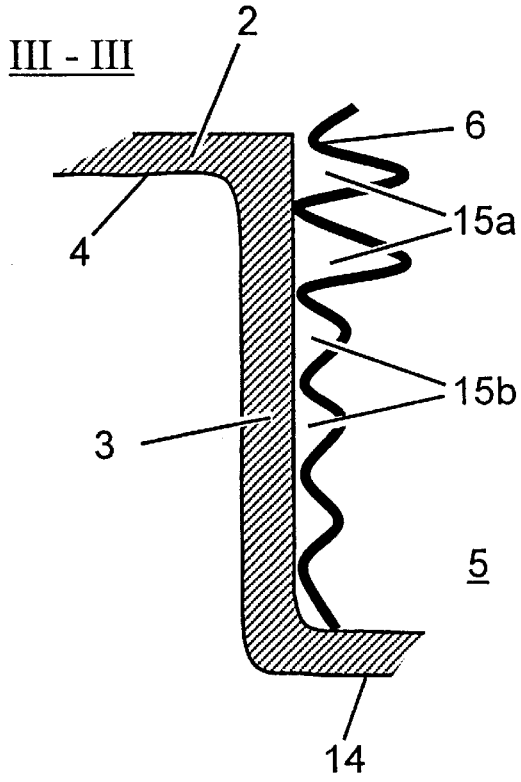
FIG. 3*b* shows a section through the turbine blade along line III—III in FIG. 2*a*, with the embodiment according to FIG. 3*a* of an insert according to the invention, which is activated thermally in a certain region.

FIGS. 3*a* and 3*b* show a further embodiment of the insert according to the invention along section III—III in FIG. 2*a*. The blade body 3 is shown in a section over the height of the blade. The portion shown in FIG. 3*a* illustrates the interior of blade body 3 from the surface 4 of platform 2 up to the blade tip 14. The wall may be the suction side 9 or also the pressure side 10 of the turbine blade 1. The insert 6 is located in the cavity 5. The corrugated shape of the insert 6 defines cooling passages 15 between the wall of the blade body 3 and the insert 6. These cooling passages 15 are reduced in size in FIG. 3*a* before the insert is thermally activated. FIG. 3*b* shows the thermally activated shape. In a top region, the insert 6 is made of a shape memory alloy. This results in enlarged cooling passages 15*a* and thus improved cooling in the top region. The unchanged cooling passages 15*b* are located in the bottom region of the blade body 3 close to the blade tip 14 of the turbine blade 1. This embodiment allows specific cooling in a region of the turbine blade 1 to be defined. An alternative embodiment could also be provided in which the cooling capacity is improved overall by forming the entire height of the insert 6 from a shape memory alloy.

Figure 3C:
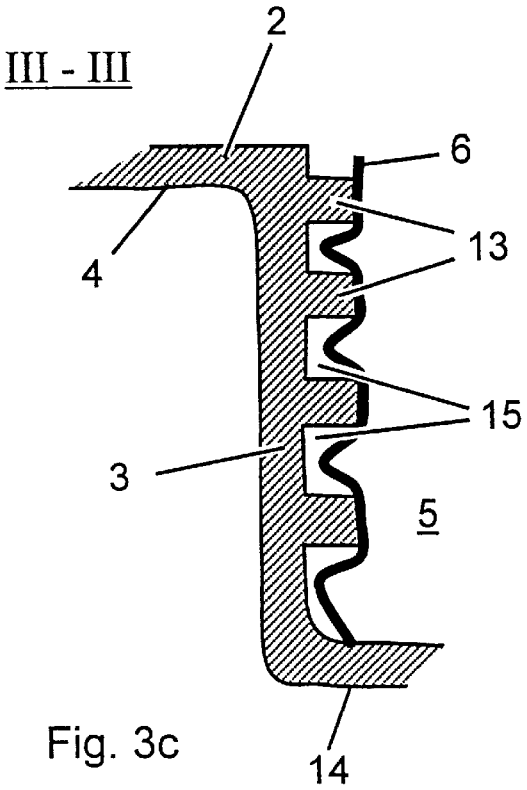
FIG. 3*c* shows a section through the turbine blade along line III—III in FIG. 2*a*, with a further embodiment of an insert according to the invention, which is not activated thermally.
Figure 3D:
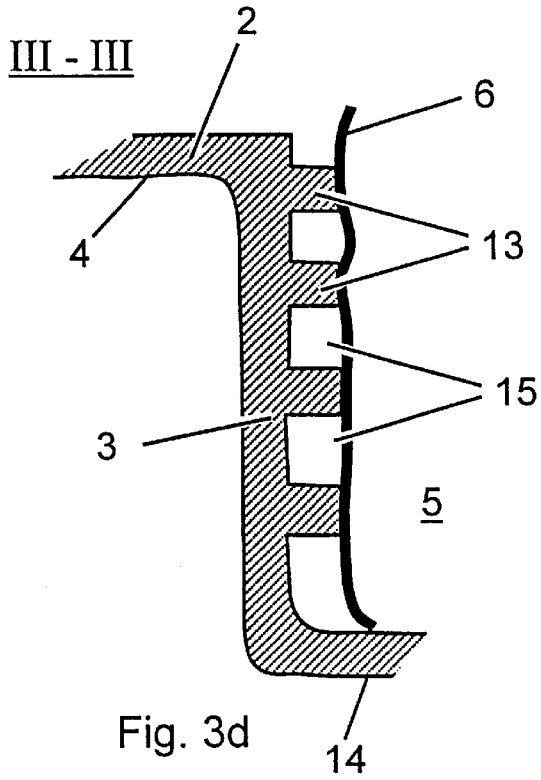
FIG. 3*d* shows a section through the turbine blade along line III—III in FIG. 2*a*, with the embodiment according to FIG. 3*a* of an insert according to the invention, which is activated thermally.

FIGS. 3*c* and 3*d* show a further embodiment of the insert according to the invention along section III—III in FIG. 2*a*. The blade body 3 is again shown in a section over the height of the blade. Ribs 13 are located on the inner wall of the hollow body in the axial direction. The wall may be the suction side 9 or also the pressure side 10 of the turbine blade 1. In principle, it makes no difference whether the following explanation refers to radial or axial ribs 13. Cooling passages 15 are produced between the ribs 13. The ribs 13 and the cooling passages 15 are covered by the insert 6 in such a way that separate cooling passages 15, separated from one another, are produced. In FIG. 3*a*, protruding portions of the insert 6 project into the cooling passages 15 when the insert 6 is not activated thermally as a result of being below a certain temperature. In FIG. 3*d*, the insert 6 has been activated thermally by a temperature increase above the predetermined temperature, which is a function of the composition of the shape memory alloy used to form insert 6. The insert 6 is reduced in size by contraction and as a result lays substantially flush across the tops of ribs 13. The cooling passages 15 are enlarged as a result of the protruding portions of insert 6 having been substantially withdrawn from the passages.

In order to utilize the effect of the contraction of an insert in the thermally activated state in an improved manner and also to ensure retention of the insert 6 on the blade body 3 of the turbine blade 1, it is necessary to mechanically fasten the insert 6 by brazing or welding to one or more points on the interior wall of the blade body 3, to the ribs in the interior of the cavity 5, to the blade tip 14, or to the platform 2 of the turbine blade 1. A bayonet fastener or a bayonet catch can also be used, so that the insert latches in place on insertion at a certain location and is rigidly fastened at this location.

The invention is not restricted to the exemplary embodiments described but relates in particular to any combination of features disclosed in the description.

What is claimed is:

1. A turbine blade of a gas turbine, comprising:

a blade body having at least one cavity in the interior of the blade, a leading edge, a suction side, a pressure side and a blade tip;

a metallic insert being positioned within said at least one cavity, said metallic insert defining at least one surface of a cooling system and at least part of said metallic insert being made of a shape memory alloy such that the size of said at least part of the insert changes with temperature as a function of the composition of the shape memory alloy during the operation of the gas turbine when a predetermined temperature is exceeded and thereby changes the size of at least part of the cooling system during the operation of the gas turbine.

2. The turbine blade according to claim 1, wherein the insert comprises a strap having two ends, said two ends of the strap being pushed one over the other at increased temperature, thereby reducing the overall size of the insert.

3. The turbine blade according to claim 1, wherein only one part of the insert is made of a shape memory alloy and thus only one part of the cooling system in the cavity is enlarged by a change in the size of the insert when the predetermined temperature is exceeded.

4. The turbine blade according to claim 3, wherein the part of the insert made of a shape memory alloy is distributed over the height of the blade body.

5. The turbine blade according to claim 3, wherein only the tip of the insert is made of a shape memory alloy, the tip being located in the region of the leading edge of the blade body, and the cooling system in the cavity being enlarged in the region of the leading edge when the predetermined temperature is exceeded.

6. The turbine blade according to claim 3, wherein parts of the insert which are made of a shape memory alloy articulate relative to parts of the insert which are not made of a shape memory alloy.

7. The turbine blade according to claim 1, wherein there are ribs on a wall in the interior of the cavity extending in a radial or axial direction, the cooling system includes cooling passages between the ribs, the insert extends over the ribs and includes protruding portions that project into the cooling passages a certain amount when the insert is below a certain temperature, and the protruding portions being substantially withdrawn from the cooling passages to thereby enlarge the cooling passages when the insert is reduced in size by a temperature increase above the certain temperature.

8. The turbine blade according to claim 1, wherein the insert is mechanically fastened by brazing or welding at discrete points in the at least one cavity, including points in the region of the blade tip or on ribs extending from a wall in the interior of the cavity.

9. The turbine blade according to claim 1, wherein the insert has cooling holes therethrough.

10. The turbine blade according to claim 1, wherein the insert is made of a shape memory alloy consisting of NiTi or CuZnAl or CuAlNi.

11. The turbine blade according to claim 10, wherein the insert is made of a shape memory alloy having a composition of 49–51% by weight Ni and 51–49% by weight Ti.

* * * * *